US009250589B1

(12) United States Patent
Eiki

(10) Patent No.: US 9,250,589 B1
(45) Date of Patent: Feb. 2, 2016

(54) FIXING DEVICE AND IMAGE FORMING APPARATUS HAVING MOVING MEMBER TO BLOCK RADIANT HEAT AND MOVING BY A FRICTION FORCE BETWEEN A FIXING BELT AND THE MOVING MEMBER

(71) Applicant: KYOCERA Document Solutions Inc., Osaka (JP)

(72) Inventor: Takashi Eiki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/818,773

(22) Filed: Aug. 5, 2015

(30) Foreign Application Priority Data

Aug. 20, 2014 (JP) ..... 2014-167075

(51) Int. Cl.
*G03G 15/20* (2006.01)

(52) U.S. Cl.
CPC ..... *G03G 15/2085* (2013.01); *G03G 15/2017* (2013.01); *G03G 15/2007* (2013.01)

(58) Field of Classification Search
CPC ..... G03G 15/2017; G03G 15/2007
USPC ..... 399/329
See application file for complete search history.

(56) References Cited

U.S. PATENT DOCUMENTS

2003/0183610 A1* 10/2003 Okabayashi ..... G03G 15/2064 219/216
2009/0162115 A1* 6/2009 Kobayashi ..... G03G 15/2053 399/329
2012/0099909 A1* 4/2012 Nanjo ..... G03G 15/2053 399/329
2014/0270833 A1* 9/2014 Yuasa ..... G03G 15/2017 399/67
2014/0341625 A1* 11/2014 Imada ..... G03G 15/2017 399/329
2015/0227094 A1* 8/2015 Yabuki ..... G03G 15/2017 399/69

FOREIGN PATENT DOCUMENTS

JP 2009-258203 A 11/2009

* cited by examiner

*Primary Examiner* — Billy Lactaoen
*Assistant Examiner* — Arlene Heredia Ocasio
(74) *Attorney, Agent, or Firm* — Studebaker & Brackett PC

(57) ABSTRACT

A fixing device includes a fixing belt, a pressuring member, a heat source, a moving member and a biasing member. The moving member is movable between a first position where the moving member blocks the radiant heat from the heat source to the fixing belt and a second position where the moving member does not block the radiant heat from the heat source to the fixing belt. The biasing member biases the moving member to the first position. The moving member moves from the first position to the second position by a friction force between the fixing belt and the moving member against a biasing force of the biasing member when the fixing belt is rotated. The moving member moves from the second position to the first position by the biasing force of the biasing member when a rotation of the fixing belt is stopped.

12 Claims, 7 Drawing Sheets

FIXING DEVICE AND IMAGE FORMING APPARATUS HAVING MOVING MEMBER TO BLOCK RADIANT HEAT AND MOVING BY A FRICTION FORCE BETWEEN A FIXING BELT AND THE MOVING MEMBER

INCORPORATION BY REFERENCE

This application is based on and claims the benefit of priority from Japanese patent application No. 2014-167075 filed on Aug. 20, 2014, the entire contents of which are incorporated herein by reference.

BACKGROUND

The present disclosure relates to a fixing device fixing a toner image on a recording medium and an image forming apparatus including the fixing device.

Conventionally, an electrographic image forming apparatus, such as a copying machine, a printer, a facsimile or a multifunction peripheral, includes a fixing device fixing a toner image on a recording medium, such as a sheet.

For example, there is a fixing device including a fixing belt, a pressuring member configured to come into pressure contact with the fixing belt so as to form a fixing nip and a heat source configured to heat the fixing belt.

With regard to the fixing device with above-mentioned configuration, when rotation of the fixing belt is stopped, a nearest part to the heat source of the fixing belt is heated by the heat source, and there is a concern that the fixing belt overshoots (overheats). Especially, when the rotation of the fixing belt is suddenly stopped according to occurrence of a JAM (paper jamming) or the like, the fixing belt is more likely to overshoot.

SUMMARY

In accordance with an embodiment of the present disclosure, a fixing device includes a fixing belt, a pressuring member, a heat source, a moving member and a biasing member. The fixing belt is configured to be rotatable. The pressuring member is configured to be rotatable and to come into pressure contact with the fixing belt so as to form a fixing nip. The heat source is configured to radiate a radiant heat to the fixing belt. The moving member is movable between a first position where the moving member blocks the radiant heat from the heat source to a nearest part to the heat source of the fixing belt and a second position where the moving member does not block the radiant heat from the heat source to the nearest part to the heat source of the fixing belt. The moving member is configured to come into contact with the fixing belt. The biasing member is configured to bias the moving member to the first position. The moving member moves from the first position to the second position by a friction force between the fixing belt and the moving member against a biasing force of the biasing member when the fixing belt is rotated. The moving member moves from the second position to the first position by the biasing force of the biasing member when a rotation of the fixing belt is stopped.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
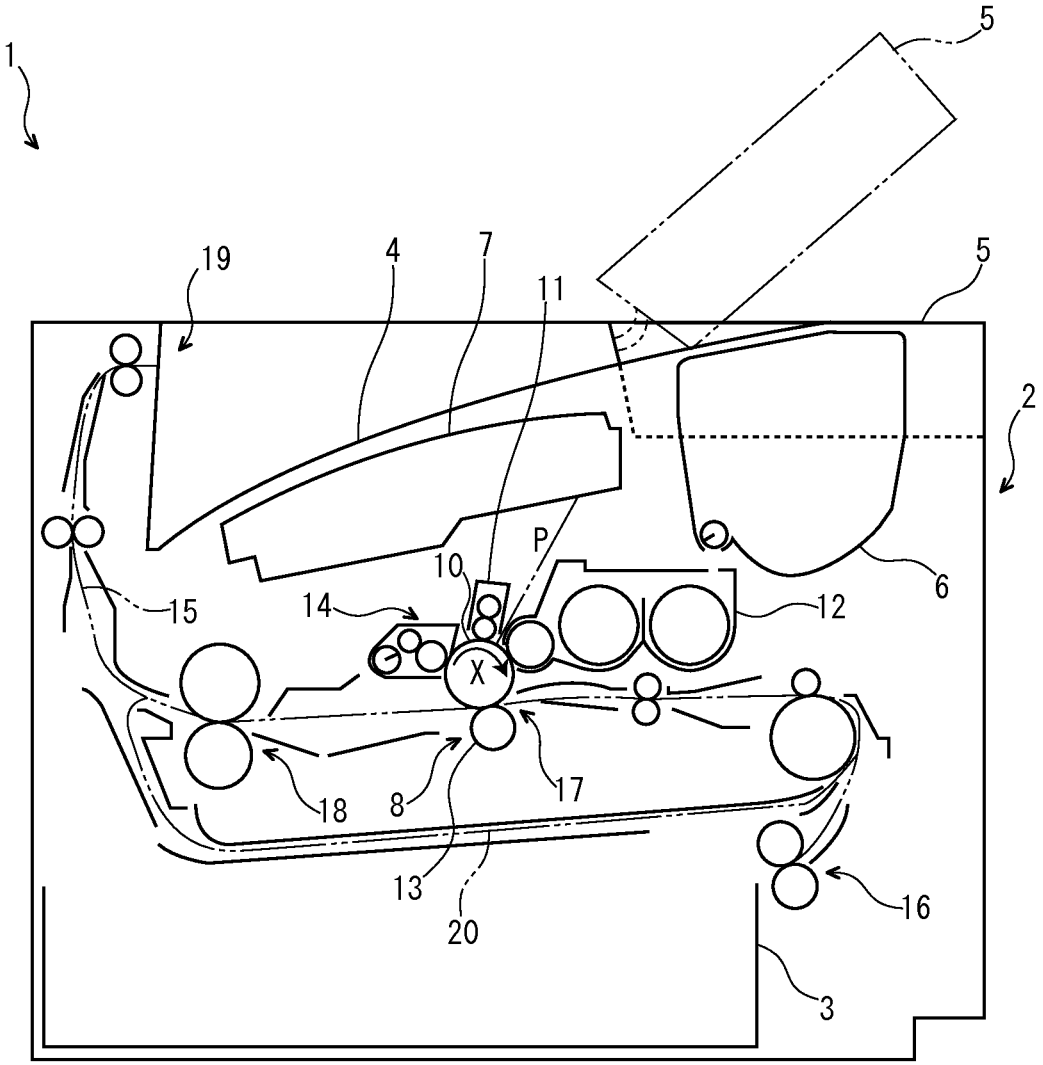
FIG. 1 is a schematic view showing a printer according to an embodiment of the present disclosure.

First, with reference to FIG. 1, the entire structure of a printer 1 (an image forming apparatus) will be described.

The printer 1 includes a box-like formed printer main body 2. In a lower part of the printer main body 2, a sheet feeding cartridge 3 storing sheets (recording mediums) is installed and, in a top face of the printer main body 2, an ejected sheet tray 4 is formed. To the top face of the printer main body 2, an upper cover 5 is openably/closably attached at a lateral side of the ejected sheet tray 4 and, below the upper cover 5, a toner container 6 is installed.

In an upper part of the printer main body 2, an exposure device 7 composed of a laser scanning unit (LSU) is located below the ejected sheet tray 4. Below the exposure device 7, an image forming part 8 is arranged. In the image forming part 8, a photosensitive drum 10 as an image carrier is rotatably arranged. Around the photosensitive drum 10, a charger 11, a development device 12, a transfer roller 13 and a cleaning device 14 are located along a rotating direction (refer to an arrow X in FIG. 1) of the photosensitive drum 10.

Inside the printer main body 2, a conveying path 15 for the sheet is arranged. At an upstream end in the conveying path 15, a sheet feeding part 16 is positioned. At an intermediate stream part in the conveying path 15, a transferring part 17 composed of the photosensitive drum 10 and transfer roller 13 is positioned. At a downstream part in the conveying path 15, a fixing device 18 is positioned. At a downstream end in the conveying path 15, a sheet ejecting part 19 is positioned. Below the conveying path 15, an inversion path 20 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out.

Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data is carried out to the photosensitive drum 10 by a laser light (refer to a two-dot chain line P in FIG. 1) from the exposure device 7, thereby forming an electrostatic latent image on the surface of the photosensitive drum 10. Subsequently, the development device 12 develops the electrostatic latent image to a toner image by a toner.

On the other hand, a sheet picked up from the sheet feeding cartridge 3 by the sheet feeding part 16 is conveyed to the transferring part 17 in a suitable timing for the above-mentioned image forming operation, and then, the toner image on the photosensitive drum 10 is transferred onto the sheet in the transferring part 17. The sheet with the transferred toner image is conveyed to a downstream side in the conveying path 15 to be inserted to the fixing device 18, and then, the toner image is fixed onto the sheet in the fixing device 18. The sheet with the fixed toner image is ejected from the sheet ejecting part 19 to the ejected sheet tray 4. The toner remained on the photosensitive drum 10 is collected by the cleaning device 14.

Next, the fixing device 18 will be described in detail. Hereinafter, a near side of FIGS. 2 and 3 will be described as a front side of the fixing device 18, for convenience of explanation. Arrows Fr, Rr, L, R, U and Lo of each figure indicate a front side, a rear side, a left side, a right side, an upper side and a lower side of the fixing device 18, respectively. An arrow I of each figure indicates an inside in a front and rear direction and an arrow O of each figure indicates an outside in the front and rear direction. An arrow Y of FIG. 2 indicates a sheet conveying direction (in the present embodiment, a left and right direction).

Figure 2:
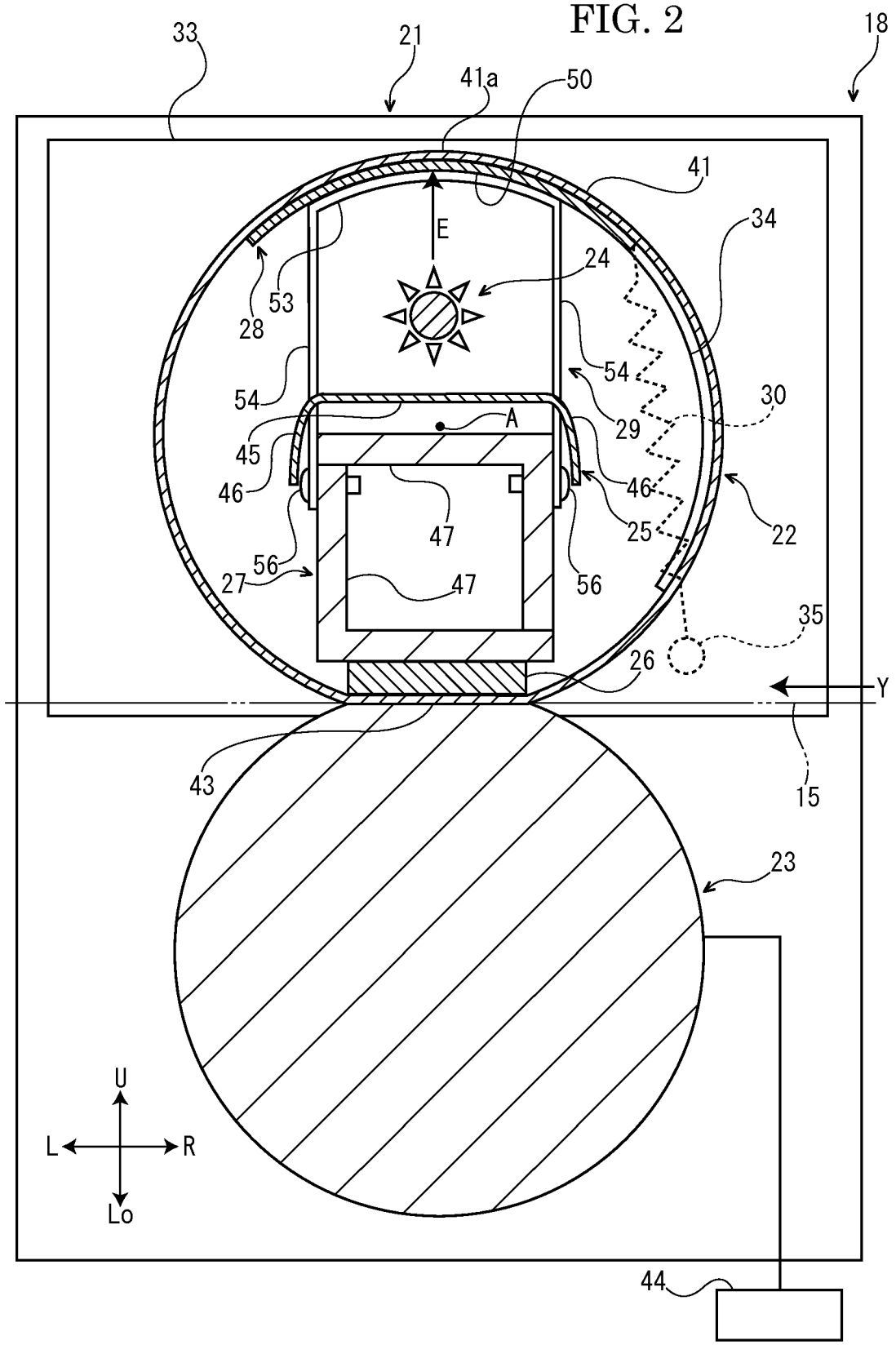
FIG. 2 is a sectional view taken along a section passing through a passing region of a fixing belt and showing a state that a moving member is in a first position in a fixing device according to the embodiment of the present disclosure.
Figure 3:
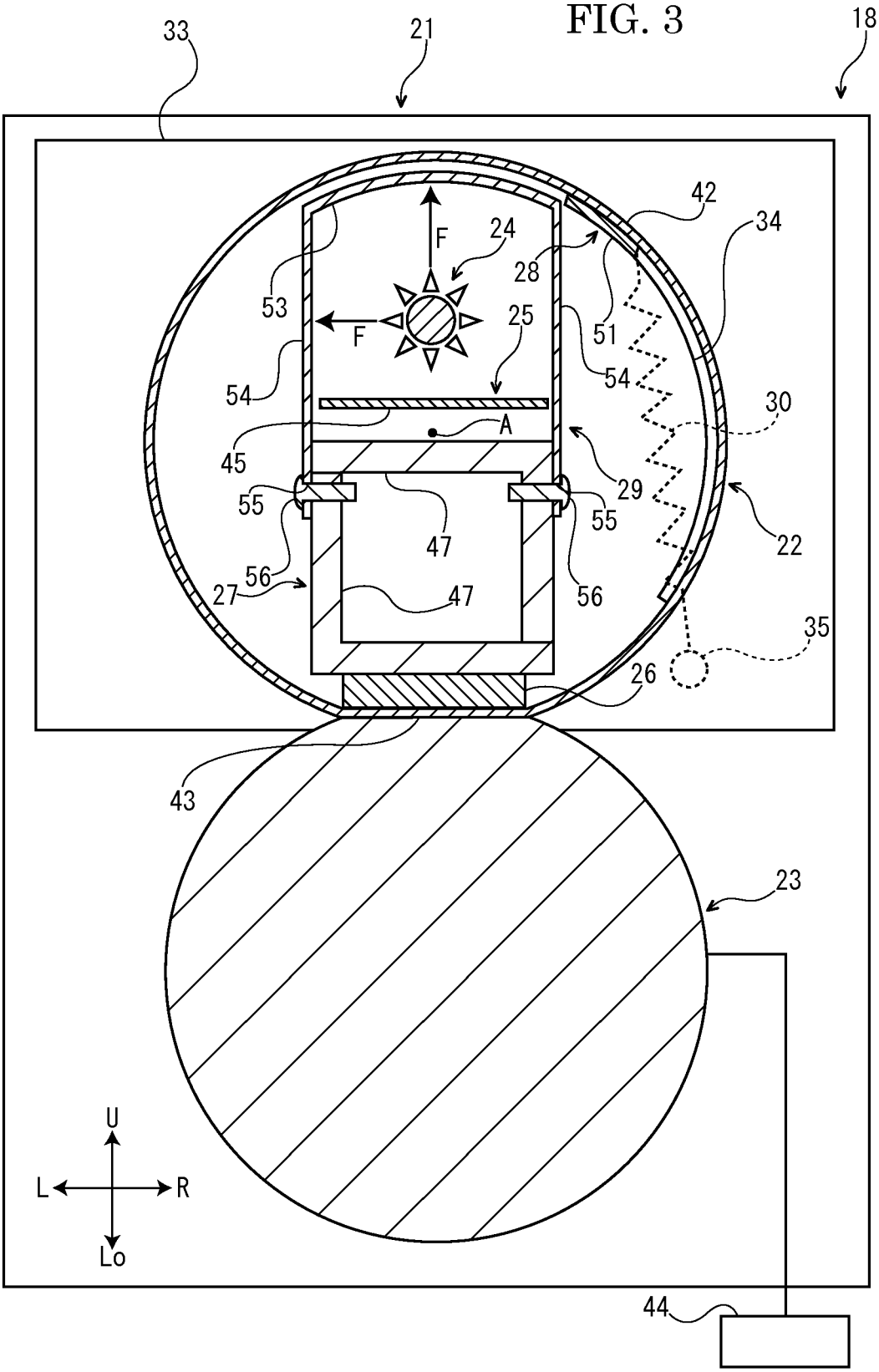
FIG. 3 is a sectional view taken along a section passing through a non-passing region of the fixing belt and showing the state that the moving member is in the first position in the fixing device according to the embodiment of the present disclosure.

As shown in FIGS. 2 and 3 and other figures, the fixing device 18 includes a fixing frame 21, a fixing belt 22 which is housed in an upper part of the fixing frame 21, a pressuring roller 23 (pressuring member) which is housed in a lower part of the fixing frame 21, a heater 24 (heat source) which is arranged at an upper part in a space at an internal diameter side of the fixing belt 22, a reflecting member 25 which is arranged at a lower side of the heater 24 in the space at the inner diameter side of the fixing belt 22, a pressing member 26 which is arranged at a lower end part in the space at the inner diameter side of the fixing belt 22, a supporting member 27 which is arranged at a lower side of the reflecting member 25 and an upper side of the pressing member 26 in the space at the inner diameter side of the fixing belt 22, a moving member 28 which is arranged along an inner circumferential face of the fixing belt 22, blocking members 29 which are respectively arranged at a front end side and a rear end side in the space at the inner diameter side of the fixing belt 22 and coil springs 30 (biasing members) which are respectively arranged at a front end side and a rear end side of the fixing frame 21.

The fixing frame 21 (see FIGS. 2 and 3 and other figures) is made of a sheet metal, for example. At upper parts of a front end part and a rear end part of the fixing frame 21, guide plates 33 (guide members) are respectively provided. Each guide plate 33 is arranged at an outside in the front and rear direction of the fixing belt 22.

Figure 4:
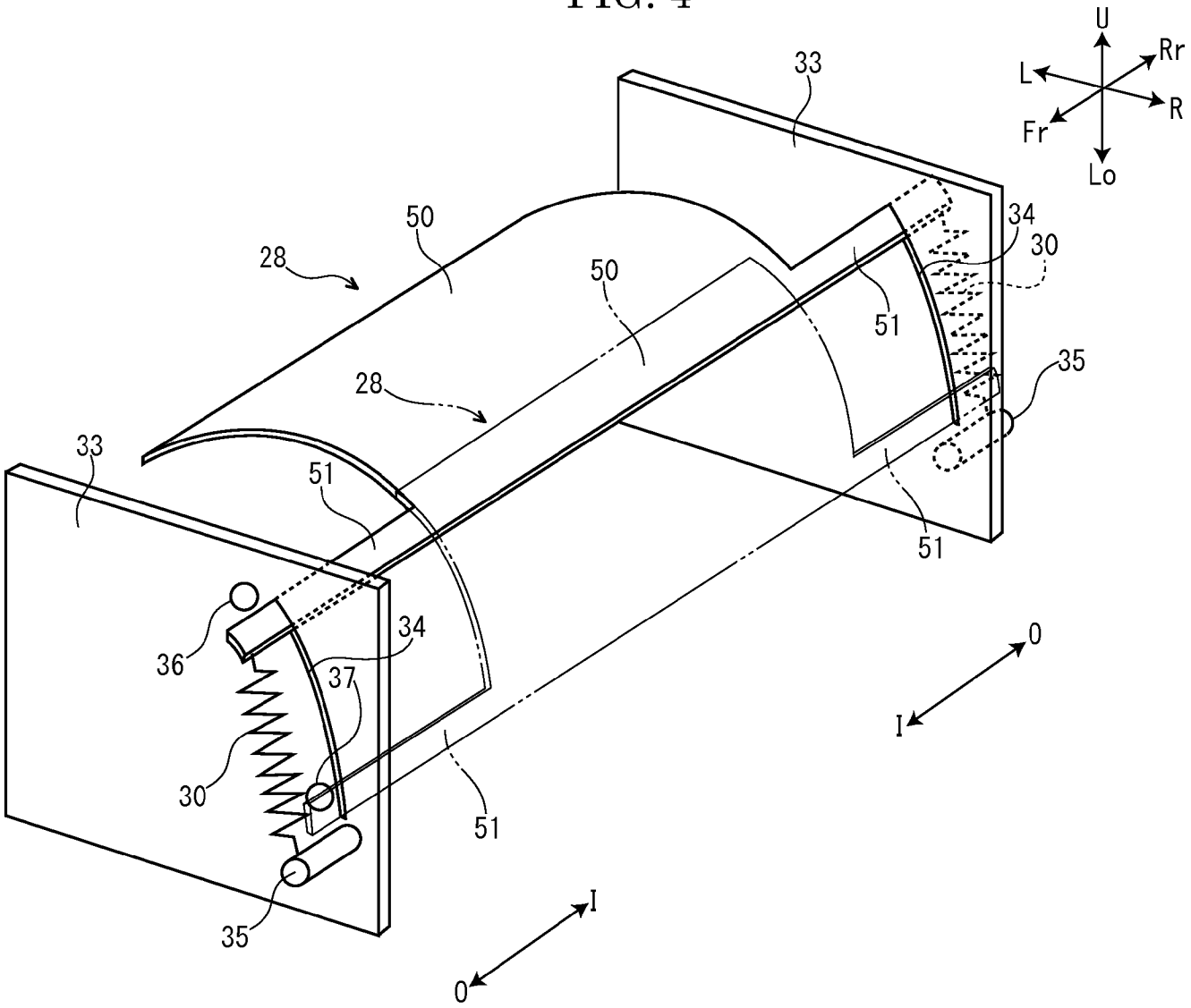
FIG. 4 is a perspective view showing the moving member, each coil spring and each guide plate in the fixing device according to the embodiment of the present disclosure.

As shown in FIG. 4 and other figures, at a right side part of each guide plate 33, a guide hole 34 curved in an arc shape is provided. In a face at an outside in the front and rear direction of each guide plate 33, an engaging protrusion 35 is protruded below the guide hole 34. In a front face (the face at the outside in the front and rear direction) of the front guide plate 33, a first detecting part 36 is fixed at an upper end side of the guide hole 34 and a second detecting part 37 is fixed at a lower end side of the guide hole 34. The first and second detecting parts 36 and 37 are composed of PI sensors (Photo Interrupter sensors), for example.

The fixing belt 22 (refer to FIGS. 2, 3 and other figures) is formed in a roughly cylindrical shape elongated in the front and rear direction. The fixing belt 22 has flexibility and is formed in an endless shape in a circumferential direction. The fixing belt 22 includes, for example, a base material layer, an elastic layer provided around the base material layer and a release layer covering the elastic layer. The base material layer of the fixing belt 22 is made of, for example, metal, such as steel special use stainless (SUS). Incidentally, the base material layer of the fixing belt 22 may be made of resin, such as polyimide (PI). The elastic layer of the fixing belt 22 is made of, for example, silicone rubber. The release layer of the fixing belt 22 is made of, for example, perfluoro alkoxy alkane (PFA) tube. Each figure shows the respective layers (the base material layer, the elastic layer and the release layer) of the fixing belt 22 without especially distinguishing.

Figure 5:
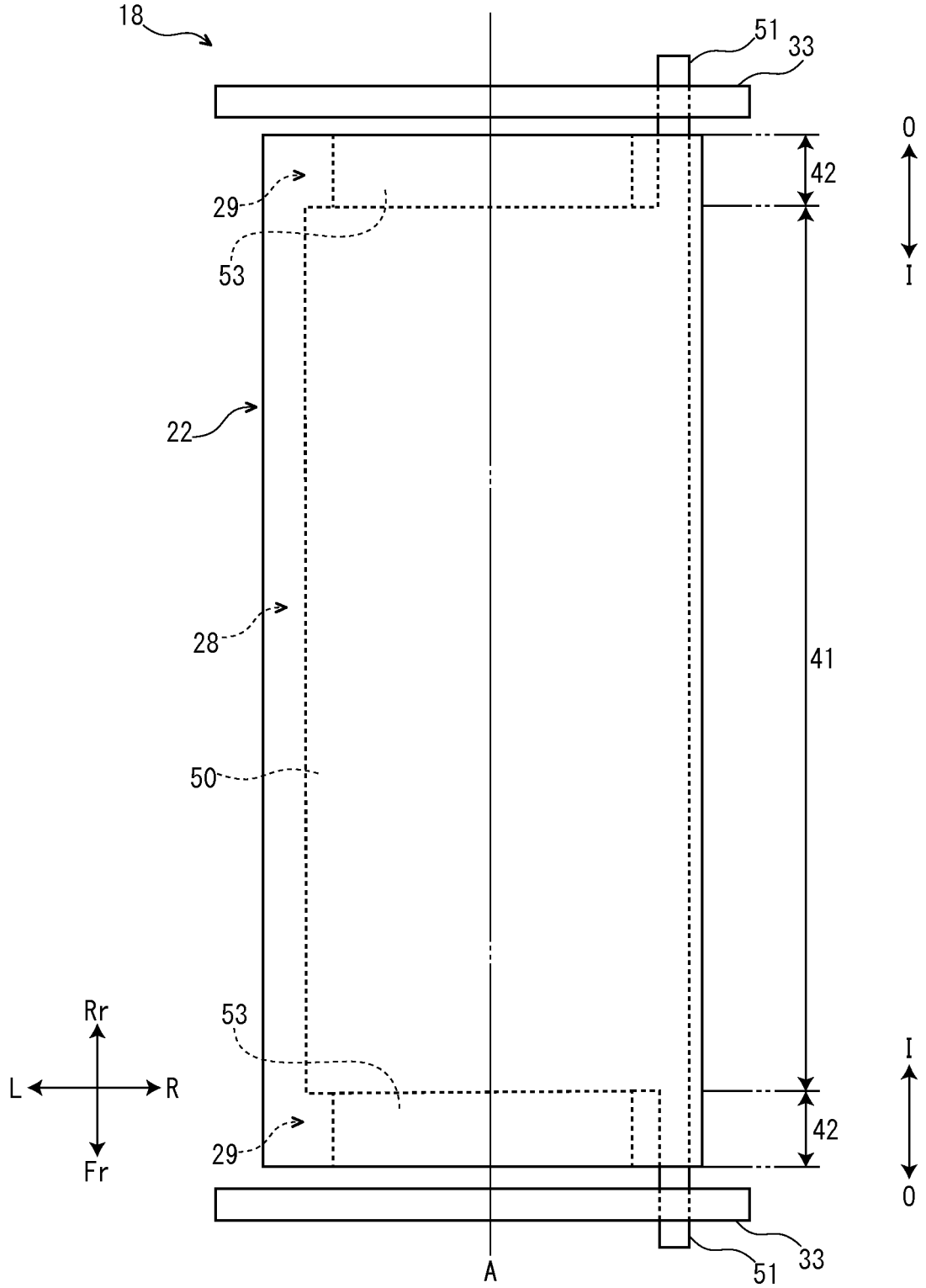
FIG. 5 is a plan view showing the fixing device according to the embodiment of the present disclosure.

As shown in FIG. 5, the fixing belt 22 is rotatable around a rotation axis A extending in the front and rear direction. That is, in the present embodiment, the rotation axis direction of the fixing belt 22 is the front and rear direction. The fixing belt 22 includes a passing region 41 and a non-passing region 42 arranged at both front and rear sides (outsides in the front and rear direction) of the passing region 41. The passing region is a region through which a sheet of maximum size passes. The non-passing region 42 is a region through which the sheet of maximum size does not pass.

The pressuring roller 23 (refer to FIGS. 2, 3 and other figures) is formed in a roughly columnar shape elongated in the front and rear direction. The pressuring roller 23 is composed of, for example, a columnar core material, an elastic layer provided around the core material and a release layer covering the elastic layer. The core material of the pressuring roller 23 is made of, for example, metal, such as iron. The elastic layer of the pressuring roller 23 is made of, for example, silicone rubber. The release layer of the pressuring roller 23 is made of, for example, PFA tube. Each figure shows the respective layers (the core material, the elastic layer and the release layer) of the pressuring roller 23 without especially distinguishing.

The pressuring roller 23 is arranged at a lower side (an outer diameter side) of the fixing belt 22. The pressuring roller 23 comes into pressure contact with the fixing belt 22 and, between the fixing belt 22 and the pressuring roller 23, a fixing nip 43 is formed. The pressuring roller 23 is rotatably supported by the fixing frame 21. The pressuring roller 23 is connected with a drive source 44 composed of a motor or the like, and the drive source 44 is configured to rotate the pressuring roller 23.

The heater 24 (see FIGS. 2 and 3 and other figures) is composed of, for example, a halogen heater. The heater 24 is arranged at an upper side (a far side from the pressuring roller 23) of the reflecting member 25, the pressing member 26 and the supporting member 27. Both front and rear end parts of the heater 24 are attached to the fixing frame 21. In addition, as shown in FIG. 2, in the passing region 41 of the fixing belt 22, an upper end part 41*a* of the passing region 41 of the fixing belt 22 is the nearest to the heater 24. The upper end part 41*a* of the passing region 41 (a nearest part to the heater 24 of the passing region 41) of the fixing belt 22 is positioned on an opposite side of the fixing nip 43 across the rotation axis A of the fixing belt 22, and faces the fixing nip 43. The heater 24 is configured to generate a heat by being energized, and radiate a radiant heat to the inner circumferential face of the fixing belt 22.

The reflecting member 25 (see FIGS. 2 and 3 and other figures) is formed in a shape elongated in the front and rear direction. The reflecting member 25 is made of a metal, such as an aluminum alloy for brightening. The reflecting member 25 is arranged between the heater 24 and the supporting member 27, and covers an upper part of the supporting member 27. As shown in FIG. 2, the reflecting member 25 includes a reflecting plate part 45 which is provided along left and right direction and a pair of bent plate parts 46 which are bent from both left and right end parts of the reflecting plate part 45 to a lower side (a side of the pressuring roller 23), and is formed in a nearly U shape which projects upward. In addition, as shown in FIG. 3, at a position corresponding to the non-passing region 42 of the fixing belt 22 in the front and rear direction, the reflecting member 25 includes only the reflecting plate part 45 and does not include each bent plate part 46. A top face of the reflecting plate part 45 has a function of reflecting a radiant heat radiated from the heater 24 to the inner circumferential face of the fixing belt 22.

The pressing member 26 (see FIGS. 2 and 3 and other figures) is formed in a shape elongated in the front and rear direction. The pressing member 26 is made of a heat resistant resin, such as LCP (Liquid Crystal Polymer). A bottom face of the pressing member 26 presses the fixing belt 22 to a lower side (the side of the pressuring roller 23).

The supporting member 27 (see FIGS. 2 and 3 and other figures) is formed in a shape elongated in the front and rear direction. The supporting member 27 is formed by combining a pair of L-shaped sheet metals 47 made of SECC (galvanized steel sheet), for example, and is formed in a shape whose cross section is a square. The supporting member 27 supports the pressing member 26 from the upper side.

Figure 6:
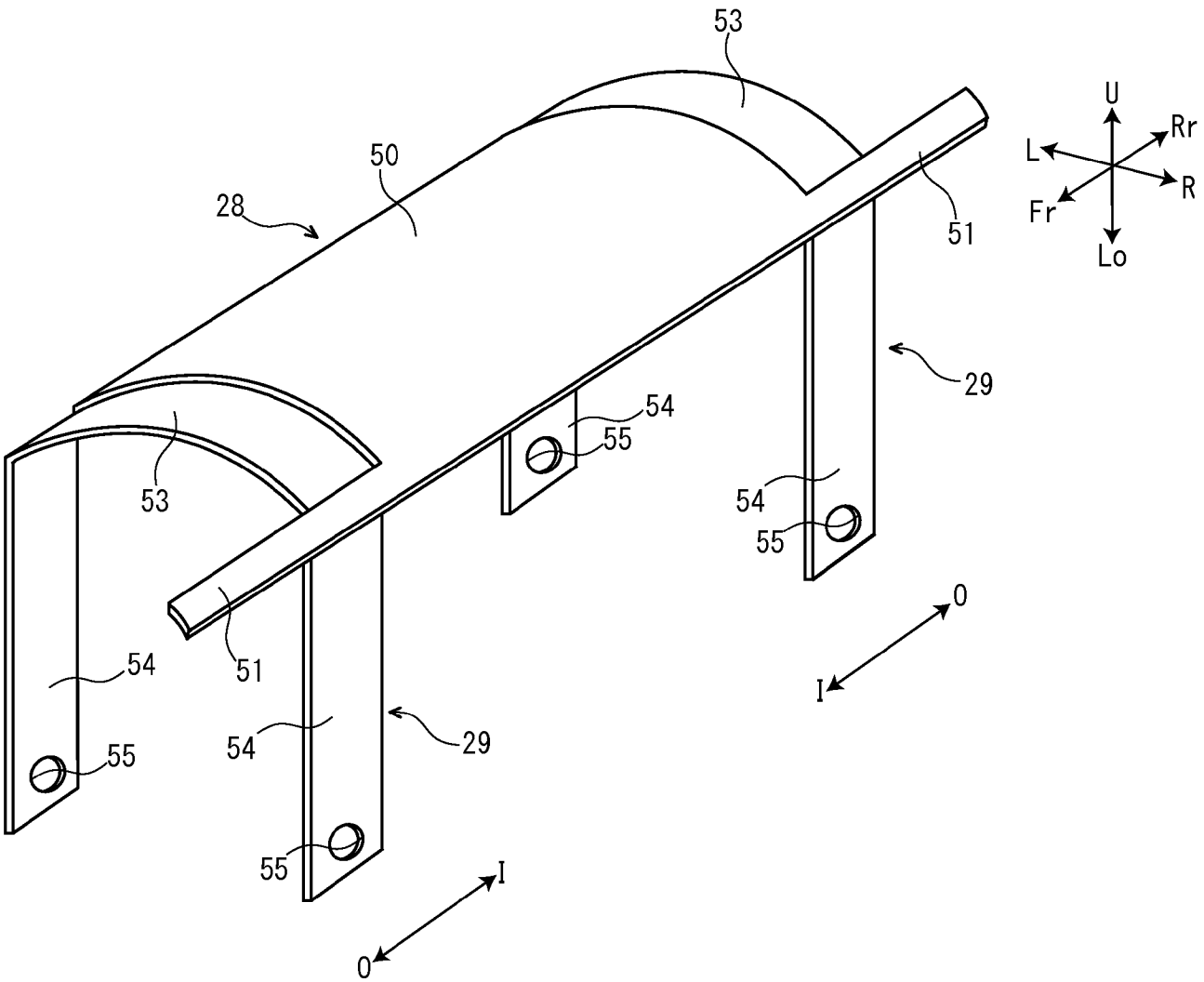
FIG. 6 is a perspective view showing the moving member and each blocking member in the fixing device according to the embodiment of the present disclosure.

The moving member 28 (see FIGS. 5 and 6 and other figures) includes a main body part 50, and a pair of extending parts 51 which extend from one end part in the width direction of the main body part 50 to an outside in the front and rear direction.

As shown in FIG. 2, the main body part 50 of the moving member 28 comes into contact with an inner circumferential face of the passing region 41 of the fixing belt 22, and is curved in an arc shape along the inner circumferential face of the passing region 41 of the fixing belt 22.

As shown in FIG. 3, a part at an inside in the front and rear direction of each extending part 51 of the moving member 28 is curved in an arc shape along an inner circumferential face of the non-passing region 42 of the fixing belt 22, and comes into contact with the inner circumferential face of the non-passing region 42 of the fixing belt 22. As shown in FIG. 4, a part at an outside in the front and rear direction of each extending part 51 is inserted into the guide hole 34 arranged at each guide plate 33. Thus, the moving member 28 is supported by each guide plate 33 to be rotatable between a first position (see a solid line in FIG. 4) and a second position (see a two-dot chain line in FIG. 4).

Each blocking member 29 (see FIG. 6 and other figures) includes a curved part 53 and fixing parts 54 which are bent from both left and right end parts of the curved part 53 to a lower side (the side of the pressuring roller 23).

As shown in FIG. 3, the curved part 53 of each blocking member 29 is curved in an arc shape along the inner circumferential face of the non-passing region 42 of the fixing belt 22. The curved part 53 is provided at an interval from the inner circumferential face of the non-passing region 42 of the fixing belt 22. A position in the front and rear direction of the curved part 53 does not overlap with a position in the front and rear direction of the main body part 50 of the moving member 28 (see FIG. 5).

As shown in FIG. 3, a lower end part of each fixing part 54 of each blocking member 29 comes into contact with both left and right side faces of the supporting member 27. At the lower end part of each fixing part 54, a fixing hole 55 is provided, and the fixing parts 54 are fixed to the both left and right side parts of the supporting member 27 by fixing screws 56 which penetrate through these fixing holes 55.

Each coil spring 30 (see FIG. 4 and other figures) is arranged at an outside in the front and rear direction of each guide plate 33. A lower end part (first end part) of each coil spring 30 is engaged with the engaging protrusion 35 of each guide plate 33. An upper end part (second end part) of each coil spring 30 is engaged with an end part at an outside in the front and rear direction of each extending part 51 of the moving member 28. By pushing each extending part 51 of the moving member 28 to an upper left side, each coil spring 30 biases the moving member 28 to the first position.

Figure 7:
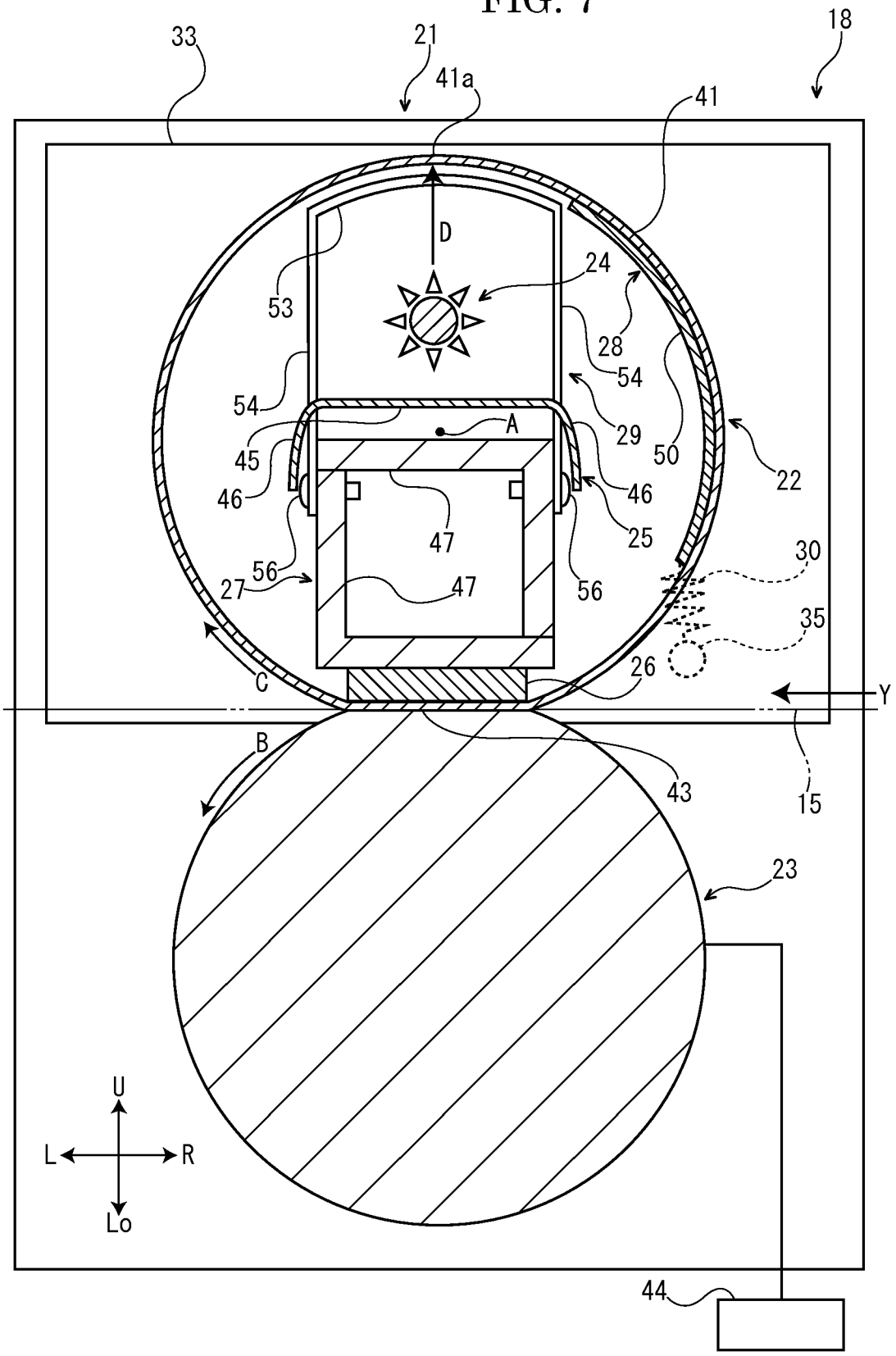
FIG. 7 is a sectional view taken along the section passing through the passing region of the fixing belt and showing a state that the moving member is in a second position in the fixing device according to the embodiment of the present disclosure.

When a sheet is fixed to a toner image in the fixing device 18 applying the above-mentioned configuration, the drive source 44 rotates the pressuring roller 23 (see arrow B in FIG. 7). When the pressuring roller 23 is rotated in this way, the fixing belt 22 which comes into pressure contact with the pressuring roller 23 is driven and rotated in a direction opposite to the pressuring roller 23 (see arrow C in FIG. 7). When the fixing belt 22 is rotated in this way, the fixing belt 22 slides against the pressing member 26.

Further, when a toner image is fixed to a sheet, the heater 24 is activated. When the heater 24 is activated in this way, a radiant heat radiated from the heater 24 heats the fixing belt 22. When the sheet passes through the fixing nip 43 in this state, the sheet and the toner image are heated and pressured, so that the toner image is fixed to the sheet.

By the way, when a rotation of the fixing belt 22 is stopped in the fixing device 18 applying the above-mentioned configuration, there is a concern that the nearest part to the heater 24 of the fixing belt 22 is heated by the heater 24 and the fixing belt 22 overshoots (overheats). Especially, when the rotation of the fixing belt 22 is suddenly stopped according to occurrence of a JAM (sheet jamming) or the like, the fixing belt 22 is more likely to overshoot. Hence, in the present embodiment, the fixing belt 22 is prevented from overshooting as follows.

As shown in FIG. 2, when an operation of fixing a toner image to a sheet is not performed (when a sheet does not pass through the fixing device 18), the rotation of the fixing belt 22 is stopped, and the moving member 28 is held at the first position by a biasing force of each coil spring 30. Further, the first detecting part 36 detects that the moving member 28 is in the first position, and the second detecting part 37 does not detect that the moving member 28 is in the second position. According to this, radiation of a radiant heat from the heater 24 is stopped.

By contrast with this, when an operation of fixing a toner image to a sheet is performed (when the sheet passes though the fixing device 18), as shown in FIG. 7, the fixing belt 22 is rotated, and, by a friction force which works between the inner circumferential face of the fixing belt 22 and the outer circumferential face of the moving member 28, the moving member 28 is rotated from the first position to the second position against the biasing force of each coil spring 30. Hence, the first detecting part 36 does not detect that the moving member 28 is in the first position, and the second detecting part 37 detects that the moving member 28 is in the second position. According to this, the heater 24 starts to be energized, and a radiant heat is radiated from the heater 24.

In a state where the moving member 28 is in the second position as described above, a radiant heat radiated from the heater 24 to the upper end part 41*a* of the passing region 41 (the nearest part to the heater 24 of the passing region 41) of the fixing belt 22 arrives at and is absorbed by the upper end part 41*a* of the passing region 41 of the fixing belt 22 without being blocked by the main body part 50 of the moving member 28 as indicated by arrow D in FIG. 7.

Meanwhile, when the rotation of the fixing belt 22 is stopped, as shown in FIG. 2, by the biasing force of each coil spring 30, the moving member 28 is rotated from the second position to the first position. In a state where the moving member 28 is in the first position, a radiant heat radiated from the heater 24 to the upper end part 41*a* of the passing region 41 (the nearest part to the heater 24 of the passing region 41) of the fixing belt 22 is blocked by the main body part 50 of the moving member 28 as indicated by arrow E in FIG. 2 and does not arrive at the upper end part 41*a* of the passing region 41 of the fixing belt 22.

Further, when the moving member 28 moves from the second position to the first position as described above, the second detecting part 37 does not detect that the moving member 28 is in the second position and the first detecting part 36 detects that the moving member 28 is in the first position. According to this, energization of the heater 24 is stopped, and radiation of a radiant heat from the heater 24 is also stopped.

In the present embodiment, as described above, during a rotation of the fixing belt 22, the heater 24 can heat the upper end part 41*a* of the passing region 41 of the fixing belt 22, so that it is possible to quickly rise the temperature of the fixing belt 22. Meanwhile, when a rotation of the fixing belt 22 is stopped, it is possible to prevent the heater 24 from heating the upper end part 41*a* of the passing region 41 of the fixing belt 22, so that it is possible to effectively prevent the passing region 41 of the fixing belt 22 from overshooting.

Further, by the friction force which works between the inner circumferential face of the fixing belt 22 and the outer circumferential face of the moving member 28, and the biasing force of each coil spring 30, the moving member 28 is rotated between the first position and the second position. Hence, compared to a case where the moving member 28 is rotated by using a drive source, such as a motor, it is possible to simplify a configuration of the fixing device 18.

Further, both when the fixing belt 22 is rotated and when the fixing belt 22 is not rotated, a radiant heat radiated from the heater 24 to the non-passing region 42 of the fixing belt 22 is blocked by the blocking members 29 as indicated by arrows F in FIG. 3. By applying such a configuration, during a rotation of the fixing belt 22, it is possible to prevent the heater 24 from heating the non-passing region 42 of the fixing belt 22. According to this, it is possible to prevent the non-passing region 42 of the fixing belt 22 from overshooting. Further, when the rotation of the fixing belt 22 is stopped, the moving member 28 can prevent the passing region 41 of the fixing belt 22 from overshooting, and the blocking members 29 can prevent the non-passing region 42 of the fixing belt 22 from overshooting. Consequently, it is possible to prevent the fixing belt 22 from overshooting in an entire region in the front and rear direction.

Further, the fixing device 18 includes the pressing member 26 which presses the fixing belt 22 to the lower side (the side of the pressuring roller 23), and the supporting member 27 which supports the pressing member 26, and each blocking member 29 is fixed to the supporting member 27. By applying such a configuration, it is possible to reduce a heat capacity of the fixing device 18 and fix each blocking member 29 by using a simple configuration.

Further, the curved part 53 of each blocking member 29 is provided at an interval from the inner circumferential face of the non-passing region 42 of the fixing belt 22. By applying such a configuration, it is possible to prevent a heat of the fixing belt 22 from escaping to each blocking member 29, so that the heater 24 can efficiently heat the fixing belt 22.

Further, the fixing device 18 includes the first detecting part 36 which can detect that the moving member 28 is in the first position, and, when the first detecting part 36 detects that the moving member 28 is in the first position, radiation of a radiant heat from the heater 24 is stopped. By applying such a configuration, it is possible to reliably prevent the heater 24 from heating the fixing belt 22 in a rotation stop state. Further, it is possible to detect whether or not the fixing belt 22 is rotating without using a complicated circuit, so that it is possible to simplify the configuration of the fixing device 18.

Furthermore, the fixing device 18 further includes the second detecting part 37 which can detect that the moving member 28 is in the second position. Consequently, it is possible to more reliably detect whether or not the fixing belt 22 is rotating.

Further, the heater 24 is arranged at an inner diameter side of the fixing belt 22, and the moving member 28 comes into contact with the inner circumferential face of the fixing belt 22 and is provided to be rotatable between the first position and the second position. By applying such a configuration, it is possible to effectively use a space at the inner diameter side of the fixing belt 22 as an arrangement space for the heater 24 and the moving member 28.

Further, the guide hole 34 which is curved in an arc shape is provided to each guide plate 33, and each extending part 51 of the moving member 28 is inserted into this guide hole 34. By applying such a configuration, it is possible to rotate the moving member 28 by using a simple configuration.

In the present embodiment, the position in the front and rear direction of the curved part 53 of each blocking member 29 does not overlap with the position in the front and rear direction of the main body part 50 of the moving member 28. In another embodiment, the position in the front and rear direction of the curved part 53 of each blocking member 29 may partially overlap with the position in the front and rear direction of the main body part 50 of the moving member 28. By applying such a configuration, it is possible to guide the moving member 28 by each blocking member 29 and to make a rotation orbit of the moving member 28 stable.

Further, in another embodiment, each extending part 51 of the moving member 28 may be guided by the curved part 53 of each blocking member 29. By applying such a configuration, it is possible to make a rotation orbit of the moving member 28 stable.

In the present embodiment, the fixing device 18 includes the first detecting part 36 and the second detecting part 37. In another embodiment, the fixing device 18 may include either one of the first detecting part 36 or the second detecting part 37

In the present embodiment, the curved part 53 of each blocking member 29 is provided at an interval from the inner circumferential face of the non-passing region 42 of the fixing belt 22. In another embodiment, the curved part 53 of each blocking member 29 may come into contact with the inner circumferential face of the non-passing region 42 of the fixing belt 22.

In the present embodiment, the heater 24 is arranged at an inner diameter side of the fixing belt 22, and the moving member 28 comes into contact with the inner circumferential face of the fixing belt 22. In another embodiment, a heat source, such as the heater 24 or the like, may be arranged at an outer diameter side of the fixing belt 22, and the moving member 28 may come into contact with the outer circumferential face of the fixing belt 22.

In the present embodiment, the halogen heater is used as a heater 24. In another embodiment, a ceramic heater or the like may be used as the heater 24.

In the present embodiment, the configuration of the present disclosure is applied to the printer 1. In another embodiment, the configuration of the present disclosure may be applied to another image forming apparatus, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt configured to be rotatable;

a pressuring member configured to be rotatable and to come into pressure contact with the fixing belt so as to form a fixing nip;

a heat source configured to radiate a radiant heat to the fixing belt;

a moving member configured to come into contact with the fixing belt and to be movable between a first position where the moving member blocks the radiant heat from the heat source to a nearest part to the heat source of the fixing belt and a second position where the moving member does not block the radiant heat from the heat source to the nearest part to the heat source of the fixing belt; and a biasing member configured to bias the moving member to the first position, wherein the moving member moves from the first position to the second position by a friction force between the fixing belt and the moving member against a biasing force of the biasing member when the fixing belt is rotated, and the moving member moves from the second position to the first position by the biasing force of the biasing member when a rotation of the fixing belt is stopped.

2. The fixing device according to claim 1, wherein the fixing belt includes:

a passing region through which a recording medium passes; and a non-passing region arranged at an outside of the passing region in a rotation axis direction of the fixing belt, the moving member blocks the radiant heat from the heat source to a nearest part to the heat source of the passing region when the moving member is in the first position and the moving member does not block the radiant heat from the heat source to the nearest part to the heat source of the passing region when the moving member is in the second position.

3. The fixing device according to claim 2, further comprising a blocking member configured to block the radiant heat from the heat source to the non-passing region both when the fixing belt is rotated and when the rotation of the fixing belt is stopped.

4. The fixing device according to claim 3, further comprising;

a pressing member configured to press the fixing belt to a side of the pressuring member; and a supporting member configured to support the pressing member, wherein the blocking member is fixed to the supporting member.

5. The fixing device according to claim 3, wherein the blocking member is arranged at an interval from the non-passing region of the fixing belt.

6. The fixing device according to claim 1, further comprising a first detecting part configured to be able to detect that the moving member is in the first position, wherein radiation of the radiant heat from the heat source is stopped when the first detecting part detects that the moving member is in the first position.

7. The fixing device according to claim 6, further comprising a second detecting part configured to be able to detect that the moving member is in the second position.

8. The fixing device according to claim 1, wherein the heat source is arranged at an inner diameter side of the fixing belt, the moving member is configured to come into contact with an inner circumferential face of the fixing belt and to be rotatable between the first position and the second position.

9. The fixing device according to claim 1, further comprising a guide member arranged at an outside of the fixing belt in a rotation axis direction of the fixing belt, wherein the moving member includes:

a main body part configured to come into contact with the fixing belt; and an extending part configured to extend from the main body part to the outside in the rotation axis direction, and the guide member has a guide hole curved in an arc shape, and the extending part is inserted into the guide hole.

10. The fixing device according to claim 9, wherein a first end part of the biasing member is engaged with an engaging protrusion arranged at the guide member, a second end part of the biasing member is engaged with the extending part.

11. The fixing device according to claim 1, wherein the nearest part to the heat source of the fixing belt is arranged at an opposite side of the fixing nip across a rotation axis of the fixing belt.

12. An image forming apparatus comprising the fixing device according to claim 1.

* * * * *